United States Patent [19]

Homann et al.

[11] Patent Number: 4,800,394

[45] Date of Patent: Jan. 24, 1989

[54] ANTENNA POLAR MOUNT ASSEMBLY

[76] Inventors: Helmut F. Homann, 16354 Greenland, Mt. Clemens, Mich. 48045; Robert J. Piper, 22494 Ray, Detroit, Mich. 48223

[21] Appl. No.: 930,535

[22] Filed: Nov. 14, 1986

[51] Int. Cl.[4] ..... H01Q 1/12; H01Q 3/04

[52] U.S. Cl. ..... 343/882; 248/183

[58] Field of Search ..... 343/765, 757, 878, 880, 343/881, 882; 248/183, 185, 176–179, 519, 521

[56] References Cited

U.S. PATENT DOCUMENTS

| | | | |
|---|---|---|---|
| 4,602,259 | 7/1986 | Shepard | 343/882 |
| 4,617,572 | 10/1986 | Hugo | 343/882 |
| 4,626,864 | 12/1986 | Micklethwaite | 343/882 |
| 4,644,365 | 2/1987 | Horning | 343/882 |
| 4,652,890 | 3/1987 | Crean | 343/882 |

FOREIGN PATENT DOCUMENTS

| | | | |
|---|---|---|---|
| 75103 | 4/1985 | Japan | 343/878 |
| 90403 | 5/1985 | Japan | 343/882 |

*Primary Examiner*—William L. Sikes
*Assistant Examiner*—Michael C. Wimer
*Attorney, Agent, or Firm*—Reising, Ethington, Barnard, Perry & Milton

[57] ABSTRACT

An antenna support assembly (10) supports a disk-type antenna on a support post (14) which defines a vertical axis and has a horizontal axis perpendicular to the vertical axis. The assembly (10) includes a housing (22) interconnecting the antenna and the support post (14) and has a slanted axis inclined relative to the vertical axis for adjusting and fixing the position of the antenna about the vertical axis for longitude and about the horizontal axis for latitude and angularly for and aft relative to the slanted axis.

3 Claims, 3 Drawing Sheets

ANTENNA POLAR MOUNT ASSEMBLY

TECHNICAL FIELD

The subject invention relates to radio antennas and, particularly, radio antennas utilized with transmitting satellites.

BACKGROUND ART

Radio antennas are extensively utilized with satellites to receive radio signals transmitted from the satellites. This is typically accomplished by an antenna mounted to a fixed mounting plate secured to a cylindrical column. A motor rotates the antenna radially with respect to a fixed axis.

The problem with such antenna mounts is that once the antennas are secured to the mounting frame, they cannot be manually adjusted. Also, these antennas cannot be adjusted radially by rotating the antanna with respect to the support column. Further, the antenna cannot be adjusted to set the polar axis of the anteanna to swing parallel to the equator.

STATEMENT OF INVENTION AND ADVANTAGES

An antenna support assembly supports a disc-type anteanna on a support post which defines a vertical axis and has a horizontal axis perpendicular to the vertical axis. A polar adjustment means is used to interconnect the anteanna and the support post and has a slanted axis inclined relative to the vertical axis for adjusting and fixing the position of the antenna about the vertical axis for longitude and about the horizontal axis for latitude and angularly fore and aft relative to the slanted axis.

Accordingly, the subject invention allows amnual adjustment of the antenna once it is secured to the support frame. Also, the antenna can be polarly rotated through manual adjustment of the antenna with respect to the support frame. Further, the antenna can be pivoted to set the polar axis of the antenna to swing parallel to the equator.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
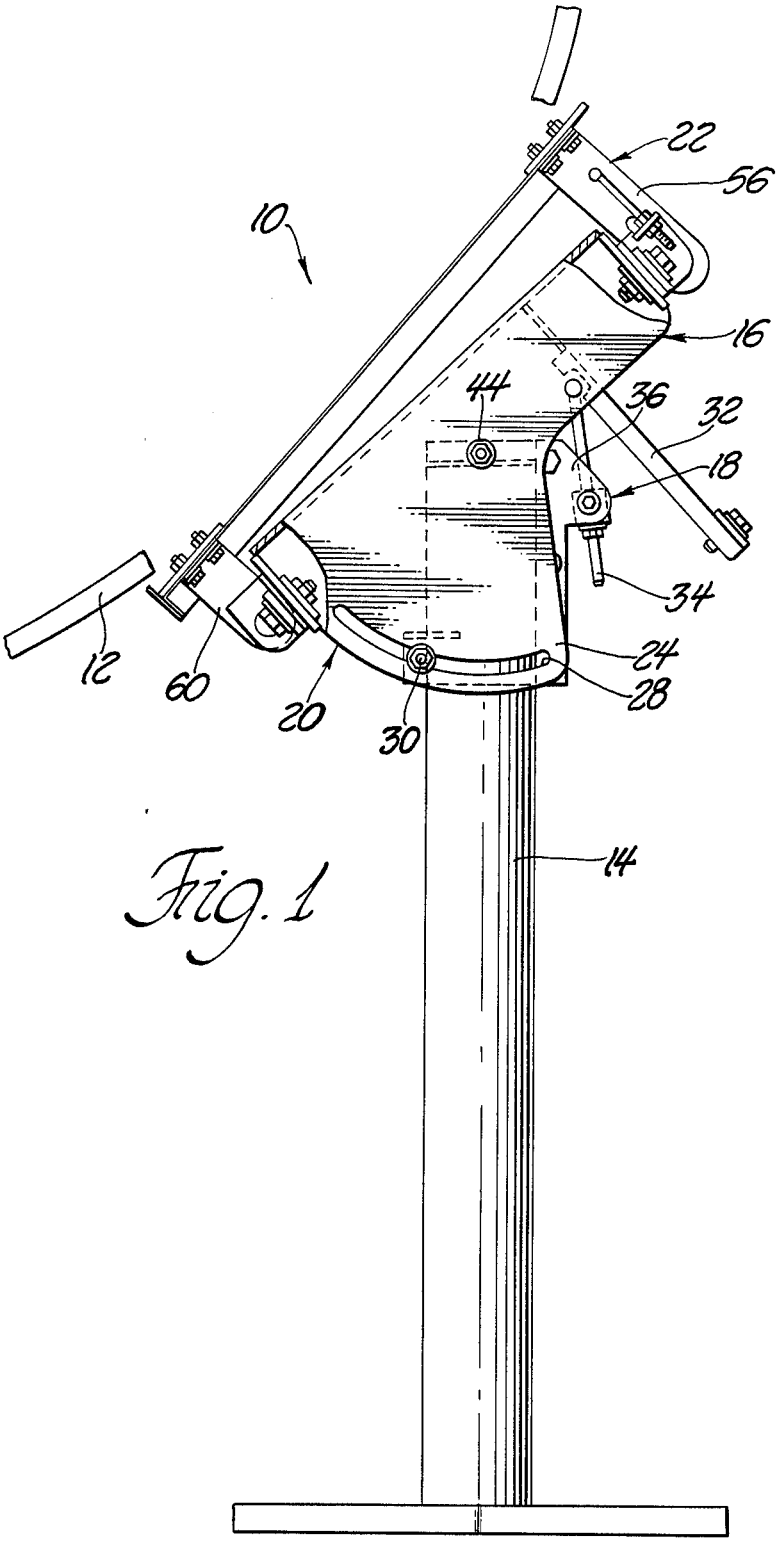
FIG. 1 is an elevational view of the subject invention partially broken away and in cross section.

A radio signal receiver or antenna support assembly is generally shown at 10 in FIG. 1. The assembly 10 supports an antenna 12 upon a support post 14 in spaced relationship to a support surface, e.g., the ground or a roof. The support post 14 defines a vertical or longitudinal axis. The assembly 10 has a horizontal axis perpendicular or at a right angle to the vertical axis, i.e., the longitudinal axis of the post 14.

The assembly 10 includes polar adjustment means, generally indicated at 16, to interconnect the antenna 12 and the support post 14. The polar adjustment means 16 has a slanted axis inclined relative to the vertical axis for adjusting and fixing the position of the antenna about the vertical axis for longitude and about the horizontal axis for latitude and angularly fore and aft relative to the slanted axis. In other words, the polar adjustment means 16 allows the antenna 12 to be rotated about two axes for longitudinal and latitudinal positions and to be pivoted fore and aft relative to the slanted axis to set the polar axis of the antenna to swing parallel to the Equator of the Earth.

The polar adjustment means 16 includes mounting means, generally indicated at 18, for securing and mounting the polar adjustment means 16 to the support post 12 and for adjustment about the vertical axis. The polar adjustment means 16 also includes housing means, generally indicated at 20, for supporting the antenna 12 upon the mounting means 18 and for adjustment about the horizontal axis. The polar adjustment means 16 further includes brace means, generally indicated at 22, secured to the housing means 20 to attach the antenna 12 to the housing means 20. The brace means 22 defines the slanted axis along the housing means 20 for adjustment of the antenna 12 angularly fore and aft relative to the slanted axis.

Figure 2:
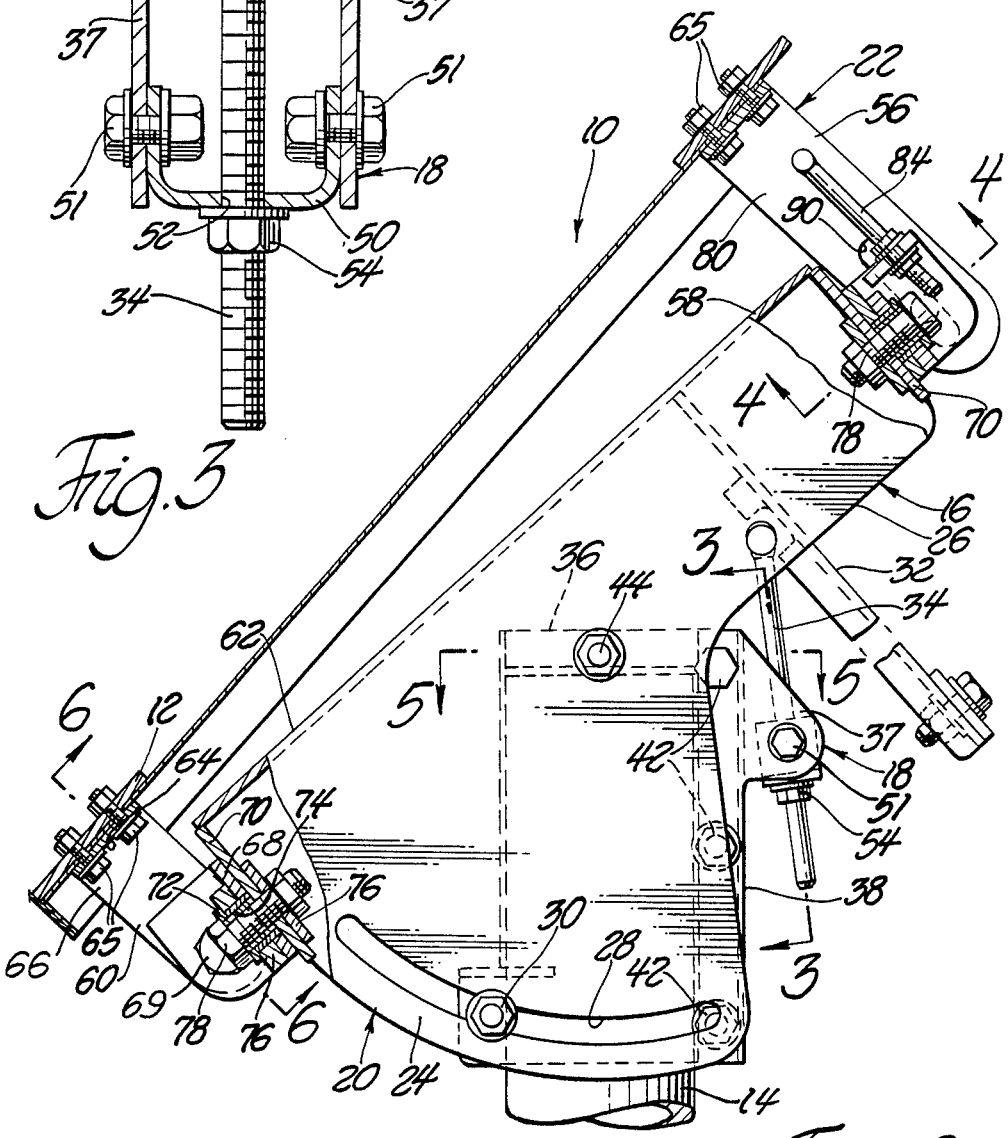
FIG. 2 is a fragmentary view of the subject invention partially broken away and in cross section.

As illustrated in FIG. 2, the housing means 20 includes a housing 24 interconnecting the brace means 22 and mounting means 18 and is pivotally secured to the mounting means 18 and the support post 14 at the horizontal axis. The housing 24 includes side flanges 26 forming a U-shaped configuration and having a curved elongated slot 28 on at least one, preferably on both, of the side flanges 26. Put another way, the housing 24 is U-shaped in cross section and has a curved elongated slot 28 for allowing adjustment of the housing means 20 latitudinally with respect to the vertical axis or the support post 14. The housing means 20 includes fastening means 30 disposed within the slot 28 for adjusting and fixing the position of the housign 24 with respect to the horizontal axis. The housing means 20 includes a support member 32 having a U-shaped cross section and disposed between the side flanges 26 of the housing 24. The support member 32 extends downwardly and outwarldy away from the ousing 24. The housing means 20 further includes a threaded rod 34 pivotally connected to the housing 24. The rod 34 is disposed between the side flanges 26 of the housing 24.

Figure 5:
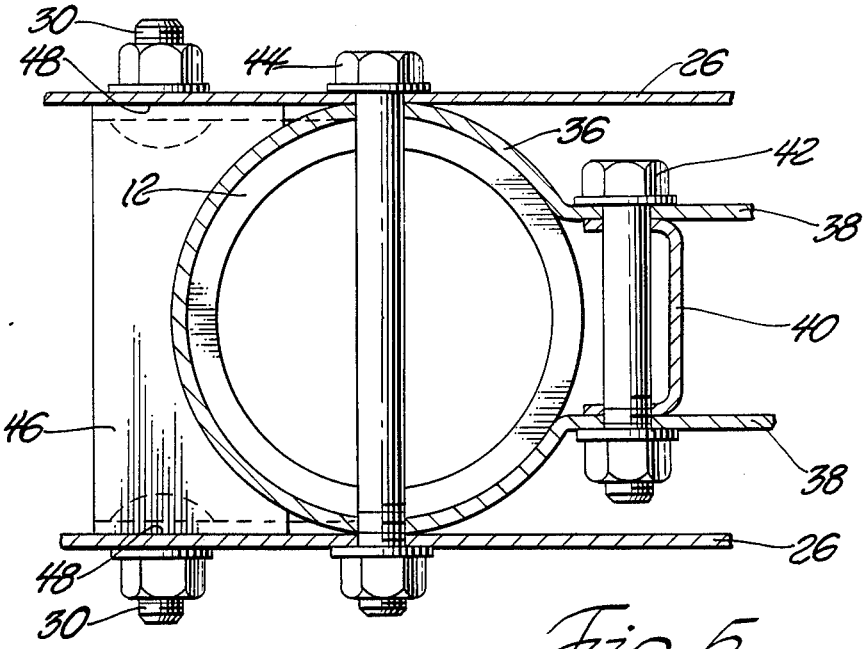
FIG. 5 is a cross-sectional view taken substantially along line 5—5 of FIG. 2.

The mounting means 18 includes a sleeve 36 rotatable about the vertical axis and having support flanges 38 extending radially and outwardly from the longitudinal axis of the sleeve 36. The support flanges 38 include a dog-ear-shaped flange 37 extending outwarldy from the top of, or the end closest to the antenna vertically, of the sleeve 36. The sleeve 63 has a cylindrical shape and is tubular. As illustrated in FIG. 5, a support member 40 is disposed between the support flanges 48. Fasteners 42 secure the support member 40 between the support flanges 38 of the sleeve 32. A fastener 44 is disposed between the side flanges 26 of the housing 24 and the sleeve 36. The fastener 44 defines the horizontal axis of the housing 24 and allows teh housign 24 to rotate or pivot with respect to the fastener 44. The sleeve 36 includes a lower step portion 46 having a U-shaped configuration opposite the support flanges 38. The step portion 46 has a bore 48 through each side flange of the step portion 46 for receiving the fasteners 30.

Figure 3:
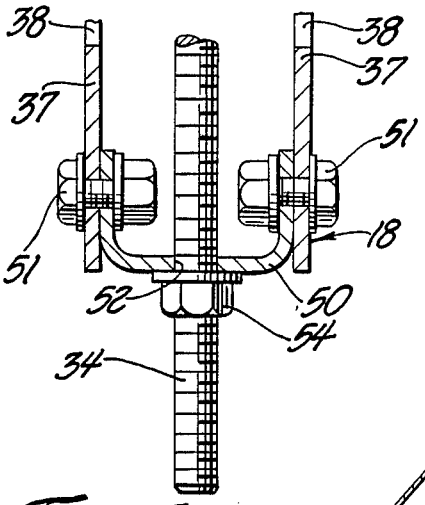
FIG. 3 is a cross-sectional view taken substantailly along line 3—3 of FIG. 2.

As illustrated in FIG. 3, the mounting means 18 includes a support bracket 50 disposed between the dog-ear flantes 37 of support flanges 38 and has a bore 52 communicating through the bracket 50. A retainer 54 threadably engageable with the threaded rod 34 secures the rod 34 in the bore 52 of the bracket 50. In other words, the rod 34 is disposed and communicates through the bore 52 of the bracket 50, and the retainer 54 secures the rod 34 in the bore 52 to allow adjustment of the rod 34 with respect to the bracket 50. Fasteners 51 secure the bracket 50 to the support flanges 38 of the sleeve 34.

The brace means 22 includes a top bracket means 56 for adjustably securing or attaching the antenna 12 to the upper portion 58 of the housing 24, and bottom bracket means 60 for fixedly securing or attaching the antenna 12 to the lowe rportion 62 of the housing 24, and fasteners 65 securing the top 56 and bottom 60 bracket means to the antenna 12 and the housing 24.

Figure 6:
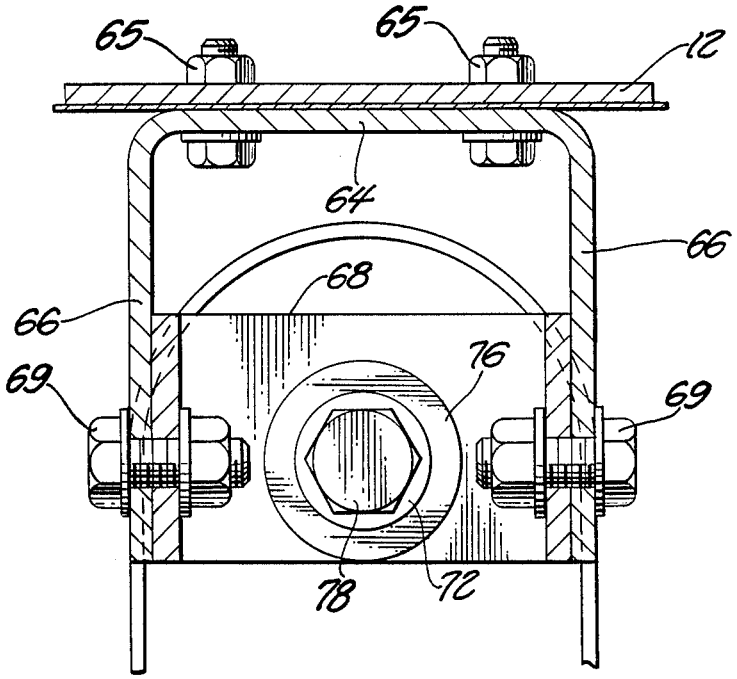
FIG. 6 is a cross-sectional view taken substantially along line 6—6 of FIG. 2.

As illustrated in FIG. 6, the bottom bracket means 60 includes an upper angle bracket 64 secured to the antenna 12 by fasteners 65 and has side portions 66 forming a U-shaped configuration. The bottom bracket means 60 further includes a lower angle bracket 68 having a U-shaped configuration disposed between the side portiosn 66 of the upper bracket 64 and connecting the upper angle bracket 64 to the housing 24. The lower angle bracket 68 is substantially perpendicular to the upper angle bracket 64. The upper angle bracket 64 is secured to the lower angle bracket 68 by fasteners 69. A plate 70 is welded or fixedly attached to partially close the end of the upper portion 58 and lower portion 62 of the housing 24. The bottom bracket means 60 includes a bushing 72 disposed in a bore 74 of the lower angle bracket 68 over a washer 76. A second washer 76 is placed over the other end of the bushing 72. A fastener 78 is disposed in the bushing 72 to secure the lower angle bracket 68 to the plate 70 of the housing 24.

Figure 4:
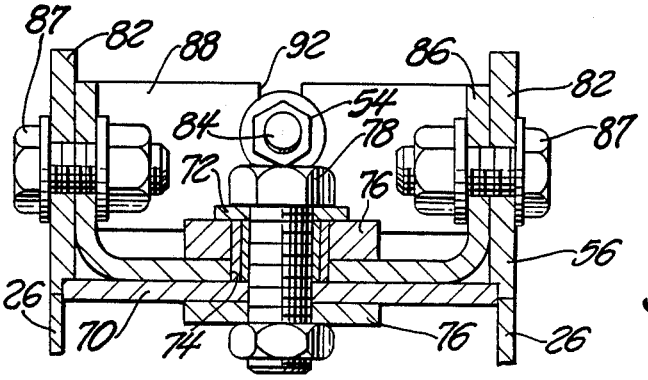
FIG. 4 is a cross-sectional view taken substantially along line 4—4 of FIG. 2.

As illustrated in FIG. 4, the top bracket means 56 includes an upper bracket 80 having side portions 82 defining a U-shaped configuration secured by fasteners 65 to the antenna 12, and a threaded rod 84 pivotally connected between the side portions 82 of the upper bracket 80. The top bracket means 56 also includes a lower bracket 86 having a U-shaped configuration with at least one closed end 88 and elongated slot 90 on the side portions of the lower bracket 86. The elongated slot 90 of the lower bracket 86 allows for adjustment of the upper bracket 80 with respect to the lower bracket 86. The closed end 88 of the lower bracket 86 has a slot 92 retaining the threaded rod 84. A retained 54 secures the rod 84 in the slot 92 to allow adjustment of the rod 84 with respect to the bracket 86. In other words, the rod 84 is disposed and communicates through the slot 92 of the bracket 86, and the retainer 54 secures the rod 84 in the slot 92 to allow adjustment of the rod 84 with respect to the bracket 86. Fasteners 87 secure the lower bracket 86 to the upper bracket 80. The lower bracket 86 is secured to the housing 24 by a bushing 72 disposed in a bore 74 of the lower bracket 86 over a washer 76. A second washer 76 is placed over the other end of the bushing 72. A second fastener 78 is disposed in the bushing 72 to secure the lower bracket 86 of the plate 70 of the housing 24. The slanted axis is defined by a straight line passing through the fasteners 78 on the housing 24.

In operation, the fasteners 30, 44, and the retainer 54 on the threaded rod 34 may be loosened so that the housing 24 is allowed to pivot about the fastener 44 or the horizontal aixs for latitude. When the desired latitude is obtained the fasteners 30, 44, and retainer 54 are secured. For longitude or rotation about the vertical axis of the support post 14, the fasteners 42 on the sleever 36 may be loosened and the sleeve 36 rotated. When the desired longitude is obtained the fasteners 42 are secured. Further, to set the polar axis of the antenna 12 to swing parallel to the Equator of the Earth, the fasteners 69 on the lower angle bracket 68 of the lower bracket means 60 and the fasteners 87 on the lower bracket 88 of the upper bracket means 56 are loosened. Further, the retainer 54 on the rod 84 is loosened to pivot the antenna 12 fore and aft of the slanted axis or about the fasteners 69 on the lower angle bracket 68. When the desired position is obtained, the fasteners 69, 87 and retainer 54 are secured.

The invention has been described in an illustrative manner, and it is to be understood that the terminology which has been used is intended to bein the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An antenna support assembly (10) for supporting a disk-type antenna (12) on a support post (14) defining a vertical axis and having a horizontal axis perpendicular to said vertical axis, said assembly (10) including a polar adjustment means (16) to interconnect an antenna (12) and a support post (14) and having a slanted axis inclined relative to said vertical axis for adjusting and fixing the position of the antenna about said vertical axis for longitude and about said horizontal axis for latitude and angularly fore and aft relative to said slanted axis, said polar adjustment means (16) including mounting means (18) for securing said polar adjustment means (16) to the support post (14) and for adjustment about said vertical axis, housing means (20) for adjustment about said horizontal axis, and brace means (22) secured to said housing means (20) to attach the antenna (12) to said housing means (20) and to define said slanted axis along said housing means (20) and for adjustment of the antenna (12) angularly for and aft relative to said slanted axis, said housing means (20) including a housing (24) pivotally secured to said mounting means (18) and the support post (14) at said horizontal axis and having side flanges (26) forming a U-shaped configuraiton and having a curved elongated slot (28) on at least one of said side flanges (26) and a fastening means (30) disposed within said slot (28) for adjusting and fixing the position of the housing (24) with respect to said horizontal axis, said brace means (22) including a top bracket means (56) for adjustably securing the antenna (12) to the upper portion (58) of said housing (24) along said slanted axis, and a bottom bracket means (60) for fixedly securing the antenna (12) to the lower portion 962) of said housing (24) along said slanted axis, said assembly characterized by said top bracket means (56) including an upper bracket (82) secured to the antenna (12) and having a U-shaped configuration, a threaded rod (84) pivotally connected between said upper bracket (82) for displacing said upper bracket (82) for and aft said slanted axis, said bottom bracket means (60) including an upper angle bracket (64) having a U-shaped configuration and a lower angle bracket (68) disposed between said upper angle bracket (64) and having a U-shaped configuration and connecting said upper angle bracket (64) to said housing (24)

2. An assembly as set forth in claim 1 wherein said housing means (20) further includes a support member (32) disposed between side flanges (26) of said housing (24) and extending downwardly and outwarldy and a second threaded rod (34) pivotally connecting said housing (24) to said mounting means (18), said second rod (34) adjusting and fixing the latitudinal position of said housing (24) with respect to said horizontal axis when said fastening means (30) allows said slot (28) of said housing (24) to move with respect to said fastening means (30).

3. An assembly as set forth in calim 2 wherein said mounting means (18) includes a sleeve (36) rotatable about said vertical axis and having support flanges (38) extending outwardly from said sleeve (36), said sleeve (36) includes a lower step portion (46) having a U-shaped configuration opposite of said support flanges (38) and having a bore (48) receiving said fastening means (30), a support member (40) disposed between said support flanges (38) to support said support flanges (38) and having a U-shaped configuration, and a support bracket (50) disposed between said support flanges (38) having a bore (52) receiving said second rod (34).

* * * * *